US009925656B2

(12) United States Patent
Chen

(10) Patent No.: US 9,925,656 B2
(45) Date of Patent: Mar. 27, 2018

(54) TOOLBOX

(71) Applicant: Compass Corporation, Tainan (TW)

(72) Inventor: Su-Chiu Chen, Tainan (TW)

(73) Assignee: Chia-Feng Chang, Tainan (TW)

( * ) Notice: Subject to any disclaimer, the term of this patent is extended or adjusted under 35 U.S.C. 154(b) by 35 days.

(21) Appl. No.: 15/089,474

(22) Filed: Apr. 2, 2016

(65) Prior Publication Data

US 2017/0282354 A1 Oct. 5, 2017

(51) Int. Cl.
*B25H 3/02* (2006.01)
*B65D 43/16* (2006.01)

(52) U.S. Cl.
CPC ..... *B25H 3/02* (2013.01); *B65D 43/167* (2013.01)

(58) Field of Classification Search
CPC .. E05D 5/10; E05D 5/12; E05D 5/121; E05D 5/125; E05D 5/127; E05D 5/128; E05D 5/14; E05D 5/16; E05D 2005/102; E05D 2005/104; E05D 2005/106; E05D 2005/108; E05D 2005/122; E05D 2005/124; E05D 2005/145; B25H 3/02
USPC ..... 16/386
See application file for complete search history.

(56) References Cited

U.S. PATENT DOCUMENTS 1,632,864 A * 6/1927 Weber ..... A45D 33/28 132/294
3,217,154 A * 11/1965 Owen ..... A45C 15/06 355/120
7,380,655 B1 * 6/2008 Thune ..... A45C 1/06 206/214
2008/0184531 A1 * 8/2008 Chao ..... G06F 1/1616 16/342
2010/0171011 A1 * 7/2010 Wang ..... F16M 11/10 248/176.3

FOREIGN PATENT DOCUMENTS

GB 376675 A * 7/1932 ..... A45D 40/30

* cited by examiner

*Primary Examiner* — J. Gregory Pickett
*Assistant Examiner* — Allan Stevens

(57) ABSTRACT

A toolbox includes a first casing having a first pivotal portion with a diameter larger than a thickness of the first casing. The first pivotal portion is hollow and has a first axial hole. A second casing includes at least one second pivotal portion pivotably connected to the first pivotal portion and having a diameter larger than a thickness of the second casing. The at least one second pivotal portion is hollow and includes a second axial hole having a diameter substantially equal to a diameter of the first axial hole. A first chamber is defined by the first and second casings in a closed state for receiving tools. A tubular member extends through the first and second axial holes and includes a receiving hole in which a tube is detachably received. The tube can receive tools.

4 Claims, 6 Drawing Sheets

TOOLBOX

BACKGROUND OF THE INVENTION

The present invention relates to a toolbox and, more particularly, to a toolbox providing improved structural strength, enhanced space utility, and carriage convenience.

Conventional toolboxes generally include two pivotably connected casings switchable between an open state and a closed state. FIG. 6 shows a conventional toolbox including first and second casings 1' and 2'. Each of the first and second casings 1' and 2' includes a bottom wall 12', 22' and a peripheral wall 11', 21' extending along a periphery of the bottom wall 12', 22'. A chamber 3' is defined by the first and second casings 1' and 2' in the closed state for receiving tools. Two first pivotal portions 13' are provided on an edge of the first casing 1'. Two second pivotal portions 23' are provided on an edge of the second casing 2'. A pivot 4' extends through each first pivotal portion 13' and a corresponding second pivotal portion 23', permitting the first and second casings 1' and 2' to pivot between the closed state and the open state.

However, the first and second pivotal portions 13' and 23' are the weak portions of the toolbox and are apt to break or damage after a period of time of use, leading to disengagement of the pivots 4'. Furthermore, the tools can only be received in the chamber 3' defined by the first and second peripheral walls 11' and 21', providing unsatisfactory space utility. Furthermore, a user still has to carry the whole toolbox when only few of them are needed.

BRIEF SUMMARY OF THE INVENTION

The primary objective of the present invention is to provide a toolbox with improved structural strength.

Another objective of the present invention is to provide a toolbox providing enhanced space utility and carriage convenience.

A toolbox according to the present invention includes a first casing having a first pivotal portion. The first pivotal portion has a diameter larger than a thickness of the first casing. The first pivotal portion is hollow and has a first axial hole. A second casing includes at least one second pivotal portion pivotably connected to the first pivotal portion. The at least one second pivotal portion has a diameter larger than a thickness of the second casing. The at least one second pivotal portion is hollow and includes a second axial hole having a diameter substantially equal to a diameter of the first axial hole. A first chamber is defined by the first and second casings in a closed state. A pivotal column includes a tubular member extending through the first and second axial holes. The tubular member includes a receiving hole. A tube includes a peripheral wall. A first end of the tube includes an end wall. The peripheral wall and the end wall define a second chamber. A second end of the tube includes an opening. A cap mounted to the second end of the tube and is operable to reveal or close the opening. The tube is removably received in the receiving hole of the tubular member.

The tubular member can include an insertion section received in the first and second axial holes and. The insertion section has an outer diameter substantially equal to the diameter of each of the first and second axial holes. The insertion section includes a slit, providing the insertion section with flexibility to permit a reduction of a size of the slit.

The pivotal column can further include an end cover. The tubular member includes an open end having a diameter larger than the diameter of each of the first and second axial holes. The tubular member further includes a coupling end opposite to the open end. The coupling end includes a first outer retaining ridge. The end cover is coupled to the coupling end of the tubular member. The end cover has an outer diameter larger than the diameter of each of the first and second axial holes. The end cover includes an end wall and a peripheral wall. An inner retaining ridge is formed on an inner face of the peripheral wall. The inner retaining ridge is coupled with the first outer retaining ridge of the tubular member.

A retaining plate can be formed on the end wall of the end cover. The first end of the tube can include a second outer retaining ridge. The second outer retaining ridge is coupled with the retaining plate of the end cover.

The open end of the tubular member can include an inner shoulder with a diameter larger than a diameter of the receiving hole. The second end of the tube can further include an outer shoulder having a diameter larger than a diameter of the second chamber. The outer shoulder is proximate to or abuts the inner shoulder of the tubular member when the tube is received in the receiving hole of the tubular member.

The second end of the tube can further include a third pivotal portion and a coupling section. The cap has a side pivotably connected to the third pivotal portion. The cap can further have a retaining ridge releasably coupled with the coupling section of the tube.

The first casing can include a first end wall and an annular first peripheral wall having an end interconnected to and surrounding the first end wall. The first pivotal portion protrudes from a side of the annular first peripheral wall. The first pivotal portion is tubular and has an outer diameter substantially equal to the sum of the thickness of the first casing and the thickness of the second casing. The first pivotal portion has a top edge flush with the first end wall. The second casing can include a second end wall and an annular second peripheral wall having an end interconnected to and surrounding the first end wall. The at least one second pivotal portion includes two second pivotal portions coaxial to and spaced from each other. The first pivotal portion is received between the two second pivotal portions. The first and second axial holes are coaxial to each other. Each of the two second pivotal portions has an outer diameter substantially equal to the sum of the thickness of the first casing and the thickness of the second casing. Each of the two second pivotal portions has a bottom edge flush with the second end wall.

The tubular member can further include a flange around the open end thereof. The flange abuts one of the two second pivotal portions.

The first pivotal portion can include first stop edge on an outer side thereof. The at least one second pivotal portion includes a second stop edge. The first stop edge abuts the second stop edge when the first and second casings are in an open state.

The present invention will become clearer in light of the following detailed description of illustrative embodiments of this invention described in connection with the drawings.

DETAILED DESCRIPTION OF THE INVENTION

Figure 1:
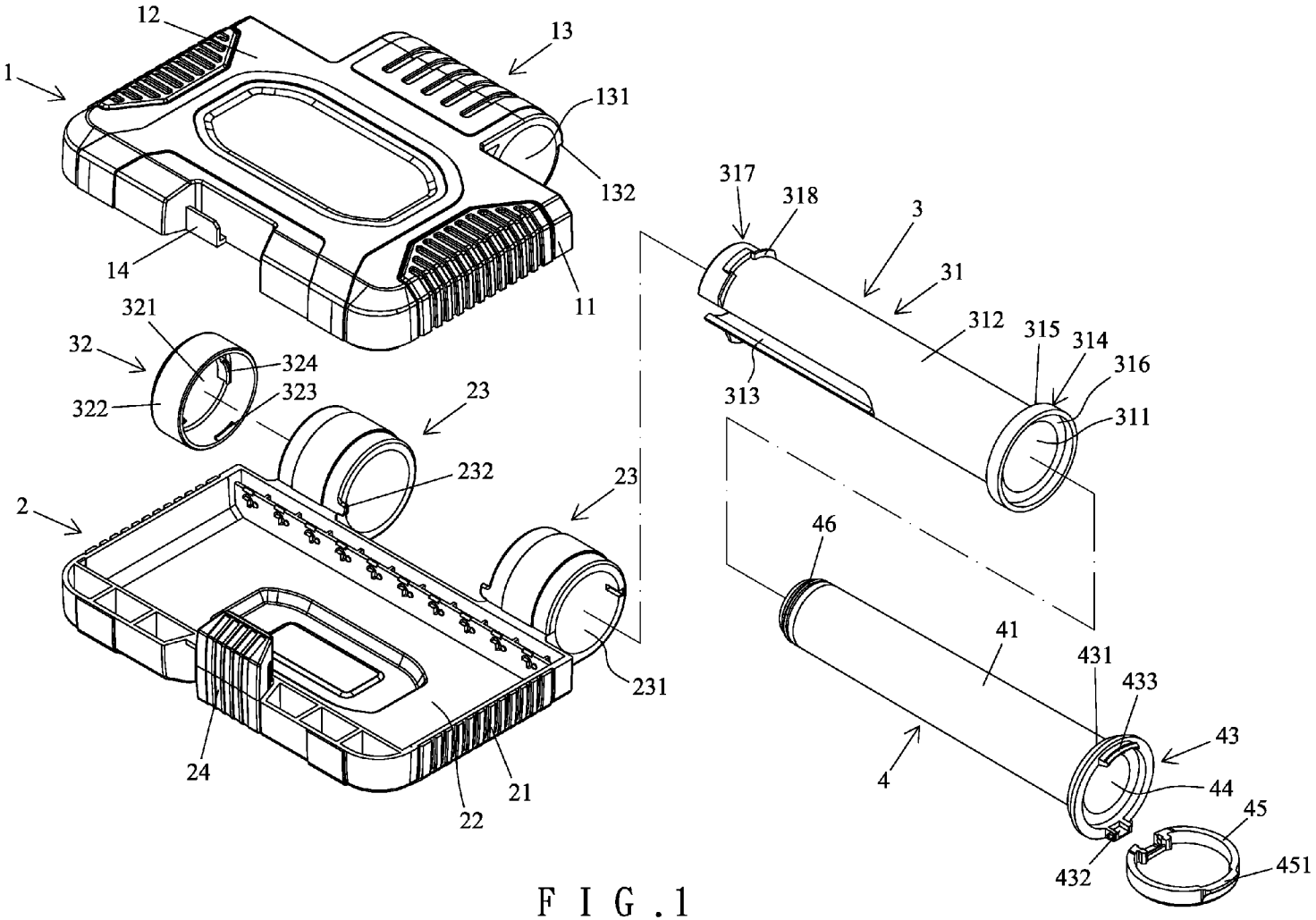
FIG. 1 is an exploded, a perspective view of a toolbox according to the present invention.
Figure 2:
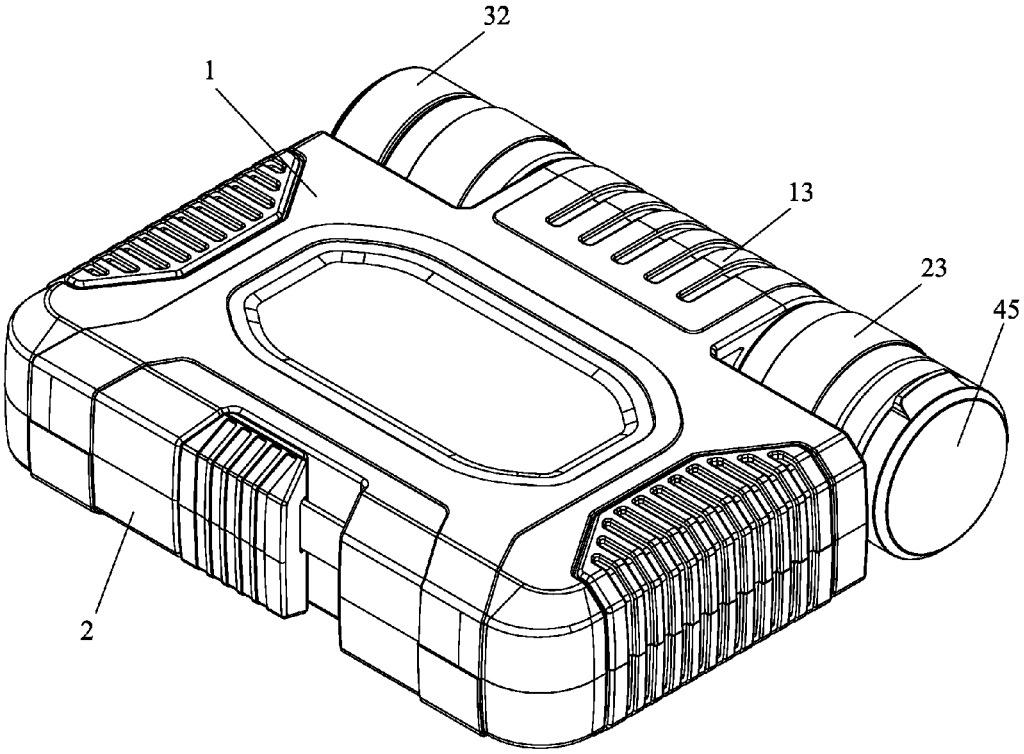
FIG. 2 is a perspective view of the toolbox of FIG. 1.
Figure 3:
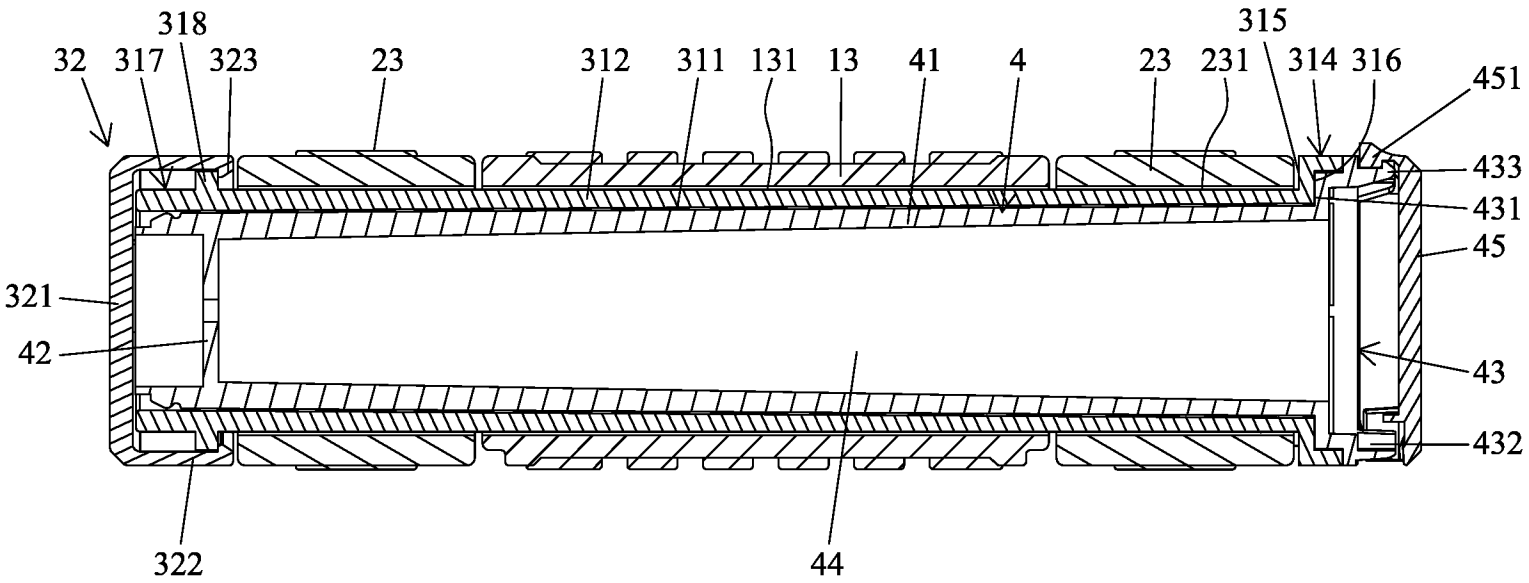
FIG. 3 is a cross sectional view of the toolbox of FIG. 2.
Figure 4:
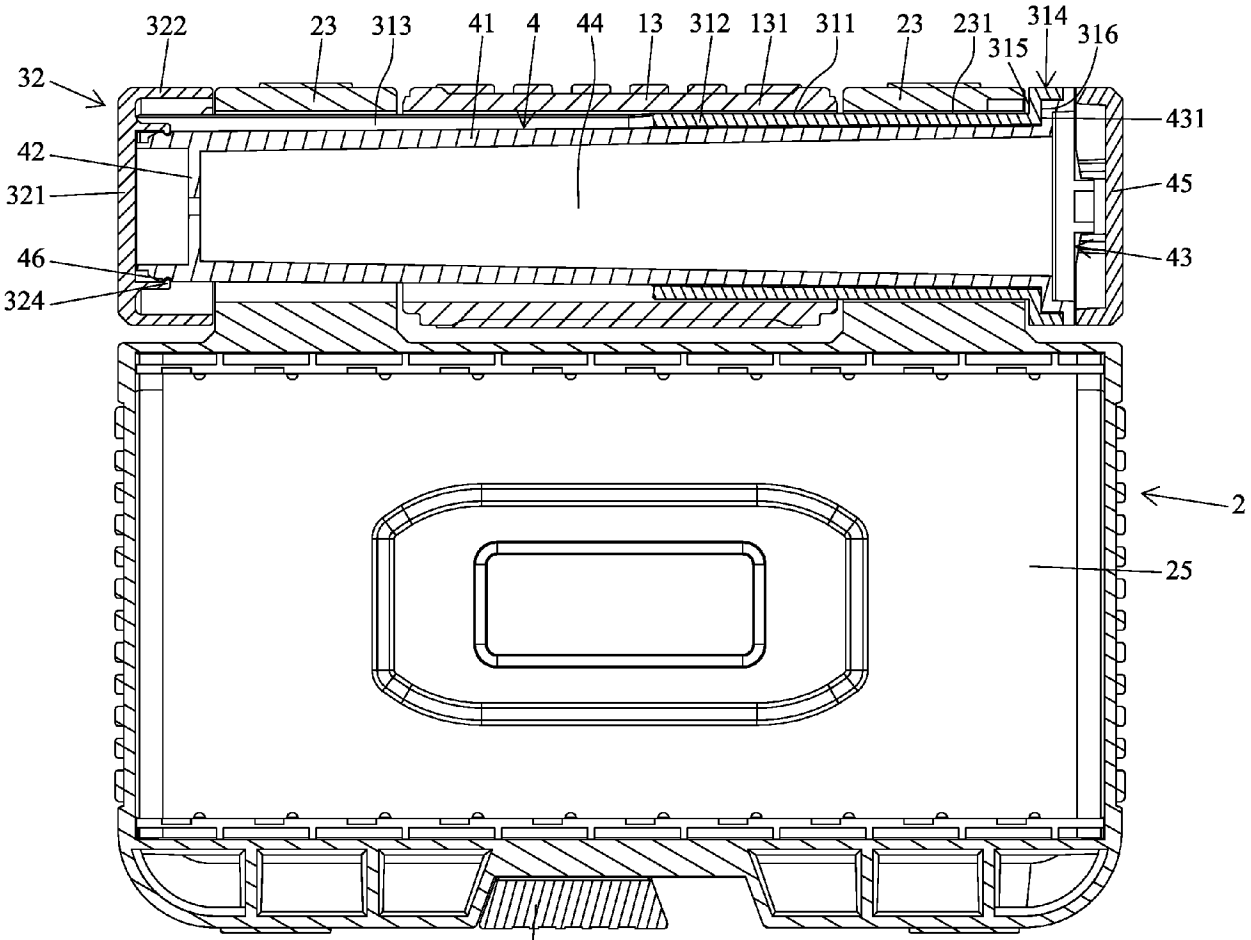
FIG. 4 is a cross sectional view of the toolbox in an open state.

With reference to FIGS. 1-4, a toolbox according to the present invention includes a first casing 1, a second casing 2, a pivotal column 3, and a tube 4. The first casing 1 includes a first end wall 12 and an annular first peripheral wall 11 having an end interconnected to and surrounding the first end wall 12. A first pivotal portion 13 protrudes outward from an intermediate portion of a side of the annular first peripheral wall 11. The first pivotal portion 13 is tubular and has a first axial hole 131. The first pivotal portion 13 has an outer diameter larger than a thickness of the first casing 1. In this embodiment, the outer diameter of the first pivotal portion 13 is substantially equal to a sum of a thickness of the first casing 11 and a thickness of the second casing 12. The first pivotal portion 13 has a top edge flush with the first end wall 12. The first pivotal portion 13 further includes first stop edge 132 on an outer side thereof.

The second casing 2 includes a second end wall 22 and an annular second peripheral wall 21 having an end interconnected to and surrounding the second end wall 22. Two second pivotal portions 23 are formed on a side of the annular second peripheral wall 21 for pivotal connection with the first pivotal portion 13. The two second pivotal portions 23 are coaxial to and spaced from each other. Each second pivotal portion 23 is tubular and includes a second axial hole 231 having a diameter substantially equal to the diameter of the first axial hole 131. The first pivotal portion 13 is received between the two second pivotal portions 23. The first and second axial holes 131 and 231 are coaxial to each other after assembly. Each of the two second pivotal portions 23 has an outer diameter substantially equal to the sum of the thickness of the first casing 11 and the thickness of the second casing 12. Each of the two second pivotal portions 23 has a bottom edge flush with the second end wall 22. Each second pivotal portion 23 includes a second stop edge 232. The first stop edge 132 abuts the second stop edges 232 when the first and second casings 1 and 2 are in an open state. Furthermore, the first casing 1 has a first buckle 14 on a side opposite to the first pivotal portion 13, and the second casing 2 has a second buckle 24 on a side opposite to the second pivotal portions 23. The first and second buckles 14 and 24 can engage with each other when the first and second casings 1 and 2 are in a closed state. A first chamber 25 is defined by the first and second casings 1 and 2 in the closed state. Tools can be received in the first chamber 25.

The pivotal column 3 includes a tubular member 31 extending through the first and second axial holes 131 and 231. The tubular member 31 includes a receiving hole 311. In this embodiment, the tubular member 31 includes an insertion section 312 received in the first and second axial holes 131 and 231. The insertion section 312 has an outer diameter substantially equal to the diameter of each of the first and second axial holes 131 and 231. Furthermore, the insertion section 312 includes a slit 313, providing the insertion section 312 with flexibility to permit a reduction of a size of the slit 313. Thus, the insertion section 312 can easily be mounted in the first and second axial holes 131 and 231 through provision of the slit 313 while providing a tight fitting effect between the outer periphery of the insertion section 312 and the inner peripheries of the first and second axial holes 131 and 231.

The tubular member 31 further includes an open end 314 having a diameter larger than the diameter of each of the first and second axial holes 131 and 231. The tubular member 31 further includes a flange 315 around the open end 314. The flange 315 can abut one of the two second pivotal portions 23 after assembly. The open end 314 of the tubular member 31 includes an inner shoulder 316 with a diameter larger than a diameter of the receiving hole 311. The tubular member 31 further includes a coupling end 317 opposite to the open end 314. The coupling end 317 includes a first outer retaining ridge 318.

The pivotal column 3 further includes an end cover 32 coupled to the coupling end 317 of the tubular member 31. The end cover 32 has an outer diameter larger than the diameter of each of the first and second axial holes 131 and 231. The end cover 32 includes an end wall 321 and a peripheral wall 322. An inner retaining ridge 323 is formed on an inner face of the peripheral wall 322 for coupling with the first outer retaining ridge 318 of the tubular member 31. The flange 315 of the tubular member 31 is proximate to or abuts an end edge of one of the two second pivotal portions 23 after the tubular member 31 extends through the first and second axial holes 131 and 231. Furthermore, the inner retaining ridge 323 is coupled with the first outer retaining ridge 318 of the tubular member 31. A side of the peripheral wall 322 of the end cover 32 is proximate to or abuts the end edge of one of the second pivotal portions 23, preventing disengagement of the pivotal column 3 after assembly, providing enhanced assembly stability. Furthermore, a retaining plate 324 is formed on the end wall 321 of the end cover 32.

The tube 4 is removably received in the receiving hole 311 of the tubular member 31. The tube 4 includes a peripheral wall 41 and first and second ends. The first end of the tube 4 includes an end wall 42. The peripheral wall 41 and the end wall 42 define a second chamber 44 for receiving tools. The second end of the tube 4 includes an opening 43 corresponding to the open end 314 of the tubular member 31. The second end of the tube 4 further includes an outer shoulder 431 having a diameter larger than a diameter of the second chamber 44. The second end of the tube 4 further includes a third pivotal portion 432 and a coupling section 433.

A cap 45 is mounted to the second end of the tube 4 and can be operated to reveal or close the opening 43. In this embodiment, the cap 45 has a side pivotably connected to the third pivotal portion 432. The cap 45 further has a retaining ridge 451 releasably coupled with the coupling section 433 of the tube 4.

The first end of the tube 4 further includes a second outer retaining ridge 46. The second outer retaining ridge 46 is coupled with the retaining plate 324 of the end cover 32 after the tube 4 is inserted through the receiving hole 311 of the tubular member 31. The outer shoulder 431 is proximate to or abuts the inner shoulder 316 of the tubular member 31 when the tube 4 is received in the receiving hole 311 of the tubular member 31, providing enhanced assembly stability.

After assembly, the pivotal connection between the first and second casings 1 and 2 is achieved by the pivotal column 3 having a large diameter. Furthermore, the tube 4 is received in the pivotal column 3. Thus, the pivotal connection is improved in structural strength. Furthermore, the first chamber 25 defined by the first and second casings 1 and 2 and the second chamber 44 defined by the tube 4 can receive tools separately, providing convenient storage and spatial utility for receiving tools.

Figure 5:
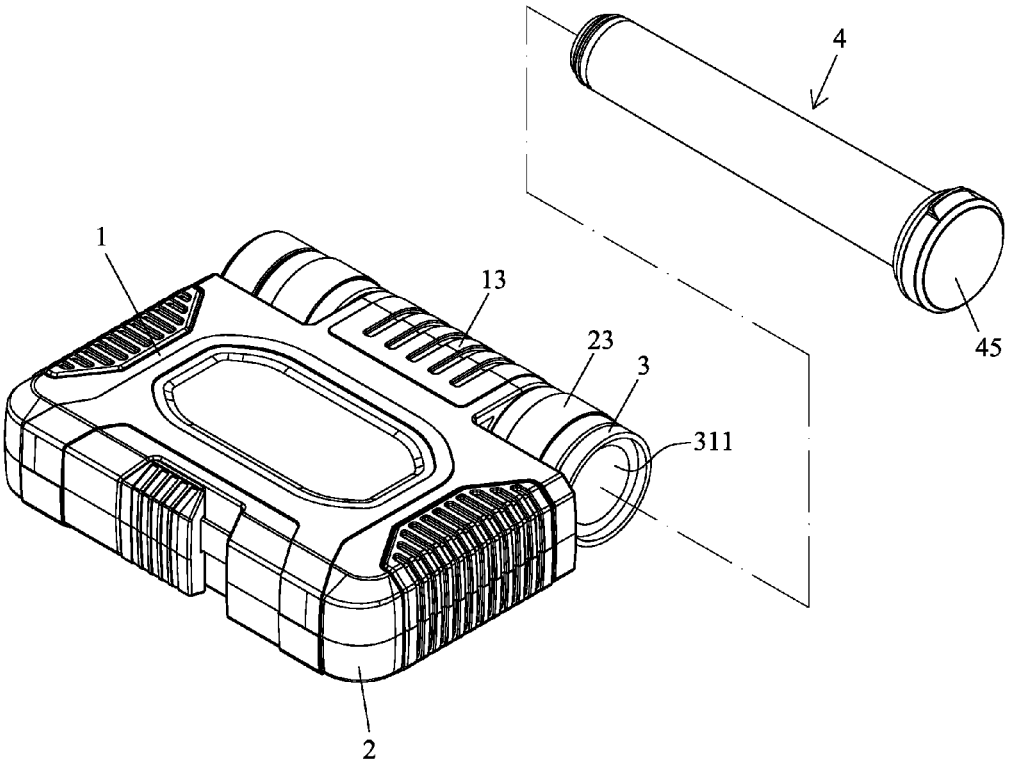
FIG. 5 is a perspective view illustrating removal of a tube from the toolbox.
Figure 6:
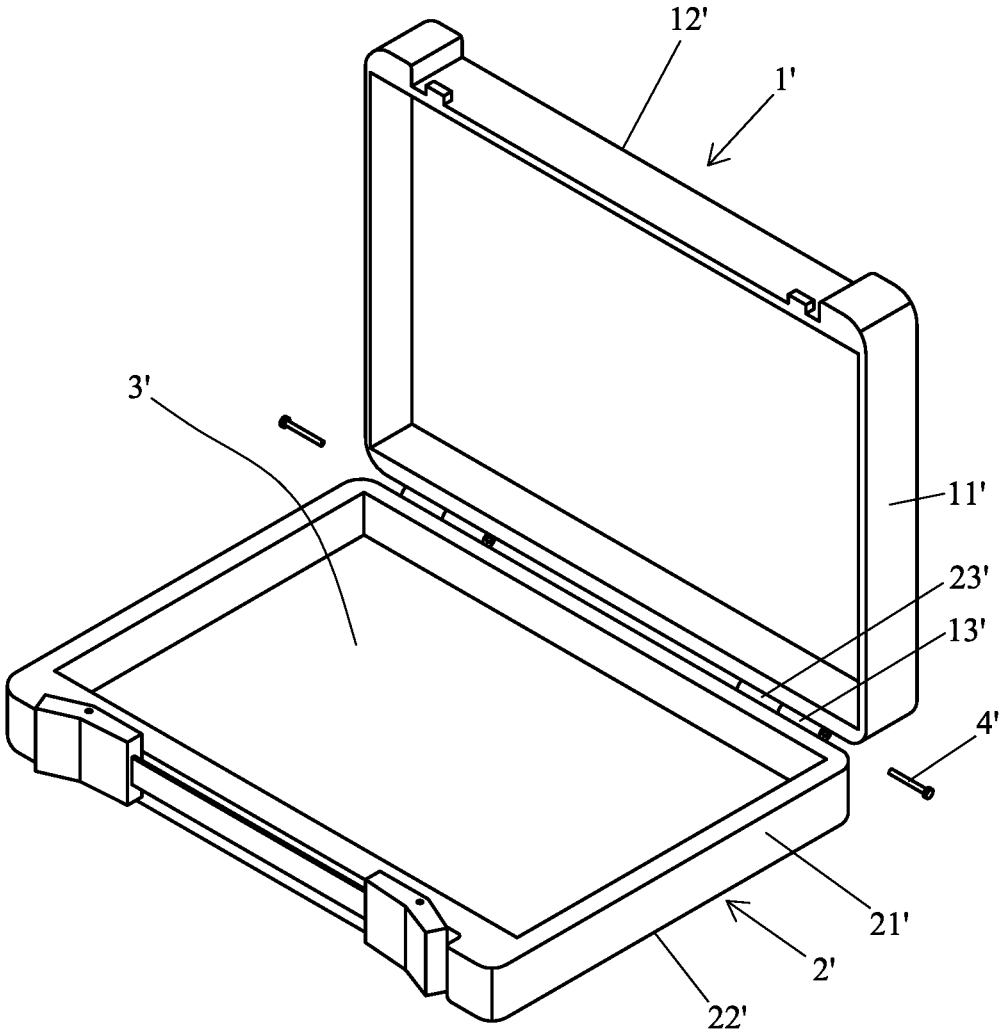
PRIOR ART F I G . 6
FIG. 6 is a perspective view of a conventional toolbox.

With reference to FIG. 5, when only few tools are to be carried, the tube 4 can be detached from the pivotal column 3 for receiving the tools, providing easy and convenient carriage.

Although specific embodiments have been illustrated and described, numerous modifications and variations are still possible without departing from the scope of the invention. The scope of the invention is limited by the accompanying claims.

The invention claimed is:

1. A toolbox comprising:

a first casing including a first pivotal portion, with the first pivotal portion having a diameter larger than a thickness of the first casing, and with the first pivotal portion being hollow and having a first axial hole;

a second casing including at least one second pivotal portion pivotably connected to the first pivotal portion, with the at least one second pivotal portion having a diameter larger than a thickness of the second casing, with the at least one second pivotal portion being hollow and including a second axial hole having a diameter equal to a diameter of the first axial hole, and with a first chamber defined by the first and second casings in a closed state;

a pivotal column including a tubular member extending through the first and second axial holes, with the tubular member including a receiving hole; and a tube including a peripheral wall and first and second ends, with the first end of the tube including an end wall, with the peripheral wall and the end wall defining a second chamber, with the second end of the tube including an opening, with a cap mounted to the second end of the tube and operable to reveal or close the opening, and with the tube removably received in the receiving hole of the tubular member, with the pivotal column further including an end cover, with the tubular member including an open end having a diameter larger than the diameter of each of the first and second axial holes, with the tubular member further including a coupling end opposite to the open end, with the coupling end including a first outer retaining ridge, with the end cover coupled to the coupling end of the tubular member, with the end cover having an outer diameter larger than the diameter of each of the first and second axial holes, with the end cover including an end wall and a peripheral wall, with an inner retaining ridge formed on an inner face of the peripheral wall, and with the inner retaining ridge coupled with the first outer retaining ridge of the tubular member.

2. The toolbox as claimed in claim 1, with a retaining plate formed on the end wall of the end cover, with the first end of the tube including a second outer retaining ridge, and with the second outer retaining ridge coupled with the retaining plate of the end cover.

3. The toolbox as claimed in claim 1, with the open end of the tubular member including an inner shoulder with a diameter larger than a diameter of the receiving hole, with the second end of the tube further including an outer shoulder having a diameter larger than a diameter of the second chamber, wherein the outer shoulder is proximate to or abuts the inner shoulder of the tubular member when the tube is received in the receiving hole of the tubular member.

4. The toolbox as claimed in claim 1, with the second end of the tube further including a third pivotal portion and a coupling section, with the cap having a side pivotably connected to the third pivotal portion, and with the cap further having a retaining ridge releasably coupled with the coupling section of the tube.

* * * * *